US005449201A

United States Patent [19]

Miller et al.

[11] Patent Number: 5,449,201

[45] Date of Patent: Sep. 12, 1995

[54] CARTON LABEL WITH PRICING SETS

[75] Inventors: Frank D. Miller, Simsbury; David S. Keith, New Haven; Kevin A. Martin, Branford, all of Conn.; Patricia J. Bulka, Merrimack, N.H.

[73] Assignee: Moore Business Forms, Inc., Grand Island, N.Y.

[21] Appl. No.: 163,746

[22] Filed: Dec. 7, 1993

[51] Int. Cl.[6] ..... B42F 3/00

[52] U.S. Cl. ..... 283/79; 283/81; 283/101; 40/312; 40/638; 428/42; 428/43

[58] Field of Search ..... 283/79, 81, 101; 40/312, 630, 638; 206/232; 428/40, 41, 43, 42

[56] References Cited

U.S. PATENT DOCUMENTS 3,993,814 11/1976 Cavender .
4,028,824 6/1977 Miller .
4,110,502 8/1978 Baer .
4,446,182 5/1984 Cavender .
4,910,058 3/1990 Jameson .
4,927,179 5/1990 Ehret et al. .
4,983,438 1/1991 Jameson .
5,031,939 7/1991 Webendorfer et al. .
5,147,699 9/1992 Browning et al. ..... 283/105 X
5,203,851 4/1993 Browning et al. .

*Primary Examiner*—Frances Han
*Attorney, Agent, or Firm*—Nixon & Vanderhye

[57] ABSTRACT

A shipping-price tag label is affixed to a package with the individual price tags surrounded on three sides of the perimeter by a shipping label portion adhesively secured to the exterior of the package, with the surfaces of the price tag portion and shipping portion substantially flush. The price tags have price indicia disposed on each of them, and a release sheet that is readily separable from the shipping label is between the price tag portions and the package, and may be detached by grasping a tab extension of the release sheet and tearing along perforation lines. A number of shipping-price tag labels maybe provided in web form, typically a cut sheet format having a first ply with a printable top surface and bottom surface covered by pressure sensitive adhesive, and a second ply comprising a release sheet with a generally C-shaped die cut formed in the release sheet, the individual price tag labels formed by die cuts in the first ply overlying the C-shaped die cut area of the release sheet.

19 Claims, 3 Drawing Sheets

FIG. 3
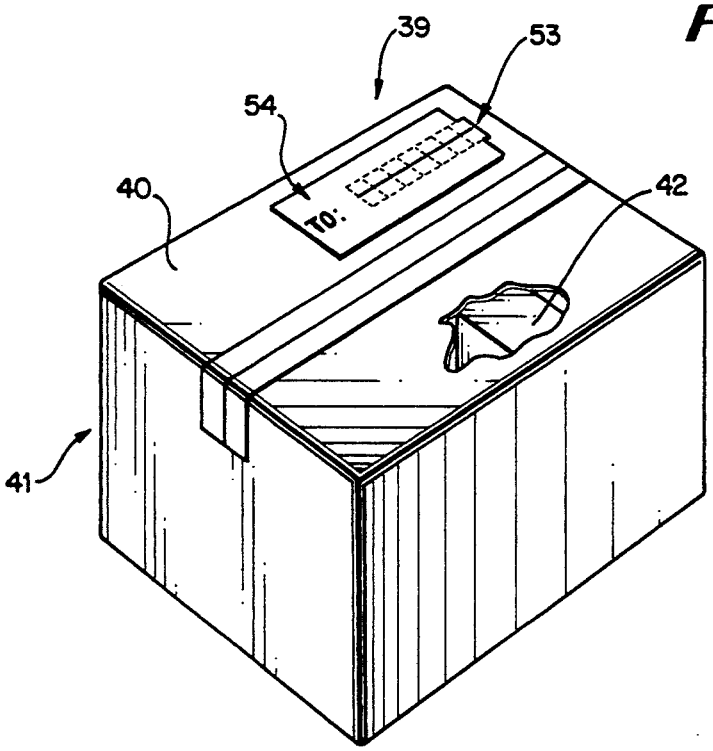
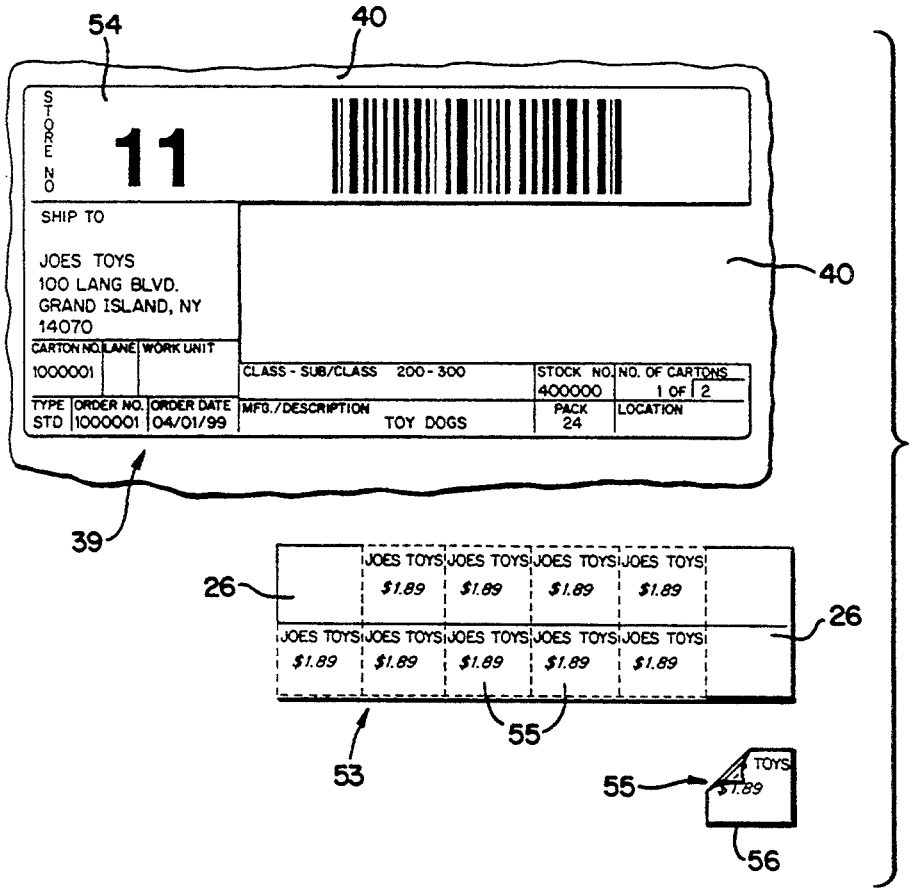
FIG. 5

CARTON LABEL WITH PRICING SETS

BACKGROUND AND SUMMARY OF THE INVENTION

In many industries, manufactured products are commonly shipped to a wholesaler, who in turn must ship the products to a retailer for subsequent sale. For the convenience of the retailer, the wholesaler often includes pre-printed price tags for the individual items contained with the shipping carton, which are removed and applied to each of the individual items within the package by the retailer, pressure sensitive adhesive on the price tags adhering them to the individual items. When this system was first used, typically the price tags were provided on a separate sheet which was disposed within the shipping carton. Then the art advanced to provide the price tags as part of the shipping label, and typically the price tags—with a release liner still backing them—were folded in one or more dimensions and tucked under the body of the shipping label for subsequent removal by the retailer, as shown in U.S. Pat. Nos. 3,993,814, 4,028,824, 4,110,502, 4,446,182, 4,927,179, 5,031,939, and 5,203,851. While this technique was commercially successful, it is disadvantageous during initial application of the labels to the cartons to have to fold up the labels, typically being a time and labor consuming process. Another alternative that has been proposed, as shown in U.S. Pat. Nos. 4,910,058 and 4,983,438, is to provide the price tags on a separate part of the shipping label, over a common release sheet which adds adhesive on the back of it which is connected to a carton; while this avoids the trouble and expense of folding up the price tag portion, it requires an additional adhesive coated ply, which may not be cost justified in some circumstances, and producing additional waste.

According to the present invention, a shipping-price tag label is provided which overcomes the drawbacks associated with the prior art as discussed above. The label according to the present invention, when applied to a carton, is only one ply in thickness over the majority of the area thereof, except for the price tag portions which have the release sheet between them and the carton exterior. The price tags are substantially flush with the shipping label, being surrounded by the shipping label approximately 270° around the perimeter thereof, yet are readily accessible and detachable from the shipping label for application to the individual articles within the package once the package is opened by the retailer.

According to one aspect of the present invention a shipping-price tag label is provided comprising the following elements: A first ply having a generally quadrate configuration, substantially parallel first and second edges, substantially parallel third and fourth edges, said third and fourth edges substantially perpendicular to the first and second edges, and first and second faces. Pressure sensitive adhesive substantially completely coveting the second face of the first ply. A substantially quadrate second ply having first and second substantially parallel edges, substantially parallel third and fourth edges, the third and fourth edges substantially perpendicular to the first and second edges, and first and second faces. The first through fourth edges of the first ply being longer than the first through fourth edges, respectively, of the second ply. The second ply first face having release material, and in engagement with the adhesive on the first ply second face, and readily releasable therefrom. The second ply positioned with respect to the first ply so that the first and second edges of the second ply are between and substantially parallel to the first and second edges of the first ply, and so that the third edge of the second ply is between the third and fourth edges of the first ply. And, the first ply having a price tag portion thereof overlying the second ply, the price tag portion comprising a plurality of individual price tags, each individually removable from the second ply and the rest of the first ply, and disposed in at least one row or column; and the first ply having a shipping label portion which does not overly the second ply.

The fourth edge of the second ply is typically on the opposite side of the fourth edge of the first ply from the third edge of the first ply, thereby forming a tab. The tab may be readily grasped to facilitate detachment of the price tags and at least a majority of the second ply from the shipping label portion of the first ply. First, second and third lines of weakness are typically formed on a second ply parallel to and adjacent the first, second and third edges, respectively of the second ply, defining a first area. The price tag overlies the first area of the second ply. The first and second lines of weakness intersect the fourth edge of the first ply, but not the fourth edge of the second ply so as to maintain integrity during feeding through a printer. The first through third lines of weakness cooperate with the tab to allow detachment of the price tags and the first area of the second ply from the shipping label portion of the first ply.

Price indicia is typically imaged on the first face of each of the price tags of the first ply, and shipping indicia is imaged on the shipping label portion of the first ply first face. Bar code indicia may be imaged on the shipping label portion of the first ply first face as part of the shipping indicia.

The invention, according to another aspect thereof, also comprises a web of shipping-price tag labels, comprising: A first ply having first and second faces, the second face having pressure sensitive adhesive on at least a majority thereof. A second ply having first and second faces, the first face having release material thereon, readily releasable from the pressure sensitive adhesive, and the first face in engagement with the adhesive of the second face of the first ply. The first and second plies each having substantially parallel first and second side edges, said side edges also substantially parallel to each other. A plurality of die cuts extending across the web substantially perpendicular to the side edges separating the first ply into a plurality of different shipping-price tag labels. A generally C-shaped die cut formed in the second ply underneath each of the shipping-price tag labels, opening adjacent the first side edge of the second ply, having first, second and third edges, and defining an inner area. A grid of die cuts formed in the first ply within a projection of the inner area of the C-shaped die cut of each of the shipping-price tag labels, defining at least one row or column of price tags. And, first, second and third lines of weakness formed in the second ply within the inner area of each of the C-shaped die cuts, and substantially parallel and adjacent to the first through third edges of the C-shaped die cut.

Typically the web is in the form of a cut sheet, each of the plies having end edges substantially parallel to each other and substantially perpendicular to the side edges. The C-shaped die cut first and second edges are adjacent, but do not intersect, the first side edge of the second ply, so that the web quickly feeds in a printer, yet allows ready removal of the price tags (with associated second ply portion) from the web.

The first edge of the first ply is typically between the first edge of the second ply and the second edge of the first ply, a tab portion defined by the second ply adjacent the price tags. Price indicia may be imaged on the first face of each of the price tags of the first ply, and shipping indicia may be imaged on the shipping label portion of the first ply first face. Three shipping-price tag labels may be provided in each sheet, and the first ply edges may be shorter than the corresponding second ply edges.

Typically the price tags comprise less than half of the first ply, and substantially the entire face of the first ply is covered with pressure sensitive adhesive. The grid typically comprises at least two columns and at least two rows.

According to yet another aspect of the present invention a package containing a plurality of substantially identical articles is provided, comprising: A cardboard box having an exterior surface. A combination shipping-price tag label having a shipping portion and a price tag portion. The shipping portion having a top surface with shipping indicia thereon, and a bottom surface substantially completely covered with pressure sensitive adhesive, the adhesive operatively engaging the cardboard box exterior surface. The price tag portion having a perimeter, and comprising a plurality of individual price tags disposed in at least one row or column, and having a top surface with price-receiving indicia thereon for receipt of a price corresponding to a price of articles within the package, and a bottom surface with pressure sensitive adhesive thereon. The price tag portion being bounded around the majority (e.g. surrounded around approximately 270°) of the perimeter thereof by the shipping portion, and the price tag portion top surface substantially flush with the shipping label portion top surface. And, a release sheet disposed between the price tag portion bottom surface and the cardboard box exterior surface.

Tab means are also typically provided for facilitating ready grasping of the price tag portion of the label on the package. Also perforation means are typically provided for facilitating ready separation thereof from the surrounding shipping portion so that the plurality of price tags, backed by a release sheet, may be readily detached from the package.

It is the primary object of the present invention to provide a simple, effective, easy to utilize shipping-price tag label, label web, and package combined with the label. This and other objects of the invention will become clear from an inspection of the derailed description of the invention and from the appended claims.

BRIEF DESCRIPTION OF THE DRAWINGS

FIG. 3 is a top perspective view of a package according to the present invention having a shipping-price tag label according to the invention provided thereon;

FIG. 5 is a view like that of FIG. 4 only showing the price tag portion of the label of FIG. 4 removed, and showing one of the price tags detached therefrom.

DETAILED DESCRIPTION OF THE DRAWINGS

Figure 1:
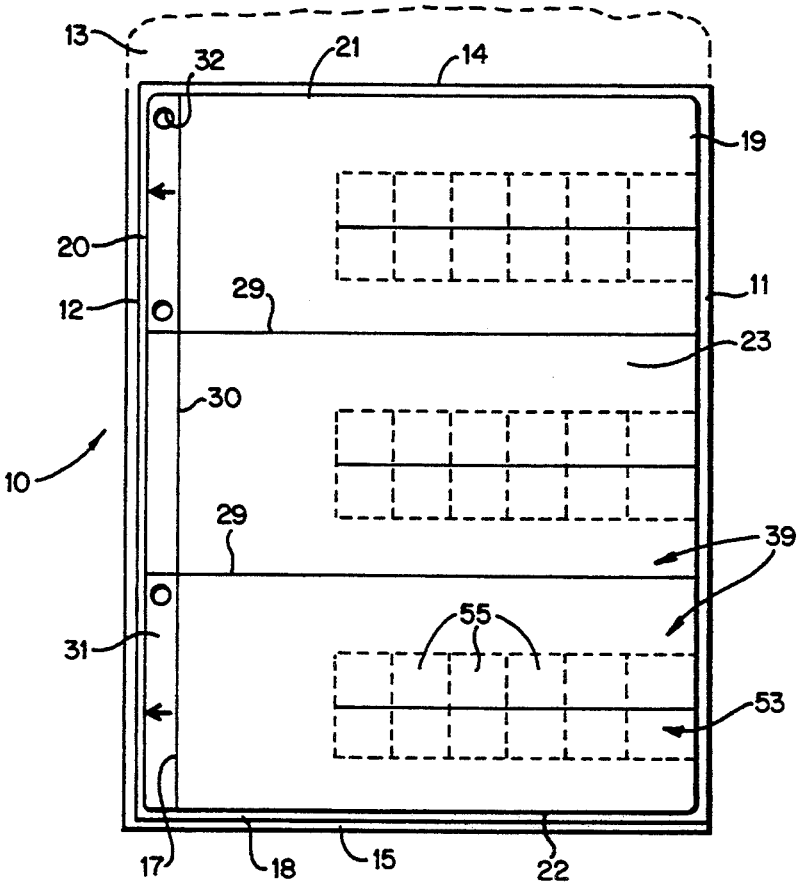
FIG. 1 is a top perspective view of an exemplary cut sheet web of shipping-price tag labels according to the present invention.
Figure 2:
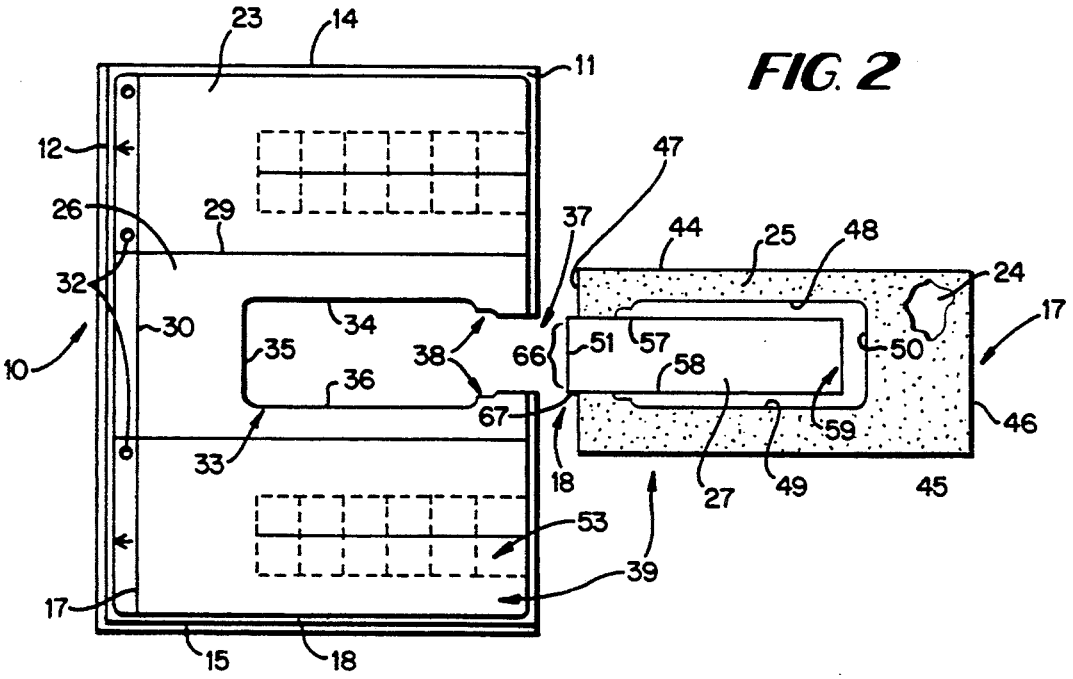
FIG. 2 is a view like that of FIG. 1 only showing one of the labels removed and turned over.

A web of shipping-price tag labels according to the present invention is shown generally by reference numeral 10 in FIGS. 1 and 2. The web 10 includes first and second side edges 11, 12, respectively, and may be in cut sheet format as illustrated in solid line in FIG. 1 (and in FIG. 2), or it may comprise part of a more continuous web as illustrated at 13 in FIG. 1, both the top of the end edges 14, 15 being connected to other portions of the web.

The web 10 comprises first and second plies, the first, top ply, being shown generally by reference numeral 17, and the second, bottom ply, being shown generally by reference numeral 18. The first through fourth edges 11, 12, 14, 15 illustrated in FIGS. 1 and 2 are the edges of the second ply 18. The first ply 17 has first through fourth edges 19 through 22 corresponding to, parallel to, and adjacent the edges 11, 12, 14, and 15, respectively, of the second ply 18. Note that it is preferred that the edges 19 through 22 of the first ply 17 each be of a slightly shorter length than the corresponding edges 11, 12, 14, 15 of the second ply 18 so that around the entire perimeter of the first ply 17 there is about a 1/16th inch wide strip which facilitates ready detachment of the individual labels from the webs 10.

Each of the plies 17, 18 has top and bottom faces. The top face of the first ply 17, is shown generally by reference numeral 23 in FIGS. 1 and 2, and is adapted to have indicia imaged thereon when the web 10 is fed through a printer, such as a laser printer, and has a bottom face 24 (see FIG. 2) which is covered with pressure sensitive adhesive 25 (e.g. the adhesive 25 substantially completely covering the face 24).

The second ply 18 also has top and bottom faces, the top face 26 thereof (see FIG. 2) being coated with a release material that does not adhere to the pressure sensitive adhesive 25, being readily detachable therefrom, and a bottom face 27 also seen in FIG. 2. The second ply 18 preferably comprises a typical release sheet, the bottom face 27 typically being standard bond or waxed paper.

In the embodiment illustrated in FIGS. 1 and 2, each cut sheet web 10 has three shipping-price tag labels associated therewith, defined by die cut lines 29 parallel to the end edges 14, 15. If desired another die cut line 30 may also be provided parallel to the side edges 11, 12, the lines 29 not intersecting the line 30, so that a perimeter strip 31 of the top ply 17 is provided. Within the strip 31 holes 32 may be punched, the holes 32 also penetrating the second ply 18.

The cut sheet web 10 according to the present invention also comprises, associated with each of the individual labels thereof, a generally C-shaped die cut shown generally by reference numeral 33 in FIG. 2, having first, second, and third edges 34 through 36, respectively, and opening up—as indicated at 37—at the first edge 11 of the second ply 18. Note that the first and third edges 34, 36 are generally parallel to each other and the end edges 14, 15 of the second ply 18, but may be contoured—as indicated generally by reference numeral 38 in FIG. 2—adjacent the open end 37 thereof.

An exemplary label according to the present invention is shown generally by reference numeral 39 in the drawings, FIG. 2 showing the label 39 detached from the web 10, and FIG. 3 showing the label 39 disposed on an exterior surface 40 of a cardboard box 41 forming a package, the box 41 filled with a plurality of substantially identical articles, shown schematically at reference numeral 42 in FIG. 3.

The label 39 is formed by first and second ply portions 17, 18, as described with respect to the web 10, and has first through fourth edges. For ease of description, the edges of the label 39 in FIGS. 2 through 5 comprise first through fourth edges indicated by reference numerals 44 through 47, respectively. The second ply portion 18 of the label 39, has first through fourth edges 48 through 51, respectively. Typically the edges 48 through 51 are significantly shorter than the edges 44 through 47, the second ply portion 18 typically having less than half of the area of the first ply portion 17 of each label 39.

The label 39 includes a price tag portion, shown generally by reference numeral 53 in the drawings, and perhaps seen most clearly in FIG. 5 where it is detached from the rest of the label 39. A portion of the label 39 exterior of the perimeter of the price tag portion 53 is the shipping portion, shown most clearly in FIG. 5 by reference numeral 54. The second ply portion 18 of the label 39 underlies the price tag portion 53, the price tag portion 53 comprising a plurality of individual price tag labels 55 each having a top surface (seen in FIGS. 1 through 5) while the bottom surface of a price tag 55 is seen in FIG. 5, and covered with adhesive 56. The price tags 55 are typically die cut from the ply 17 and in a grid configuration as illustrated in all of the drawings, a plurality thereof being disposed in at least one row or column, and preferably in at least two rows and at least two columns as seen in all of FIGS. 1 through 5.

In order to allow ready detachment of the price tag portion 53 from the rest of the label 39, lines of weakness are provided in the second ply portion 18 of the label 39 as seen in FIG. 2. Preferably first through third lines of weakness, such as perforation lines 57 through 59, respectively, are provided which are parallel to and adjacent the lines 48 through 50, respectively, of the second ply portion 18 of the label 39, as seen in FIG. 2.

As seen in FIG. 3, the label 39 is provided in combination with the cardboard box 41 with the price tag portion 53 being surrounded around approximately 270° of the perimeter thereof by the shipping portion 54, with the price tag portion 53 top surface substantially flush with the shipping label portion 54 top surface.

Figure 4:
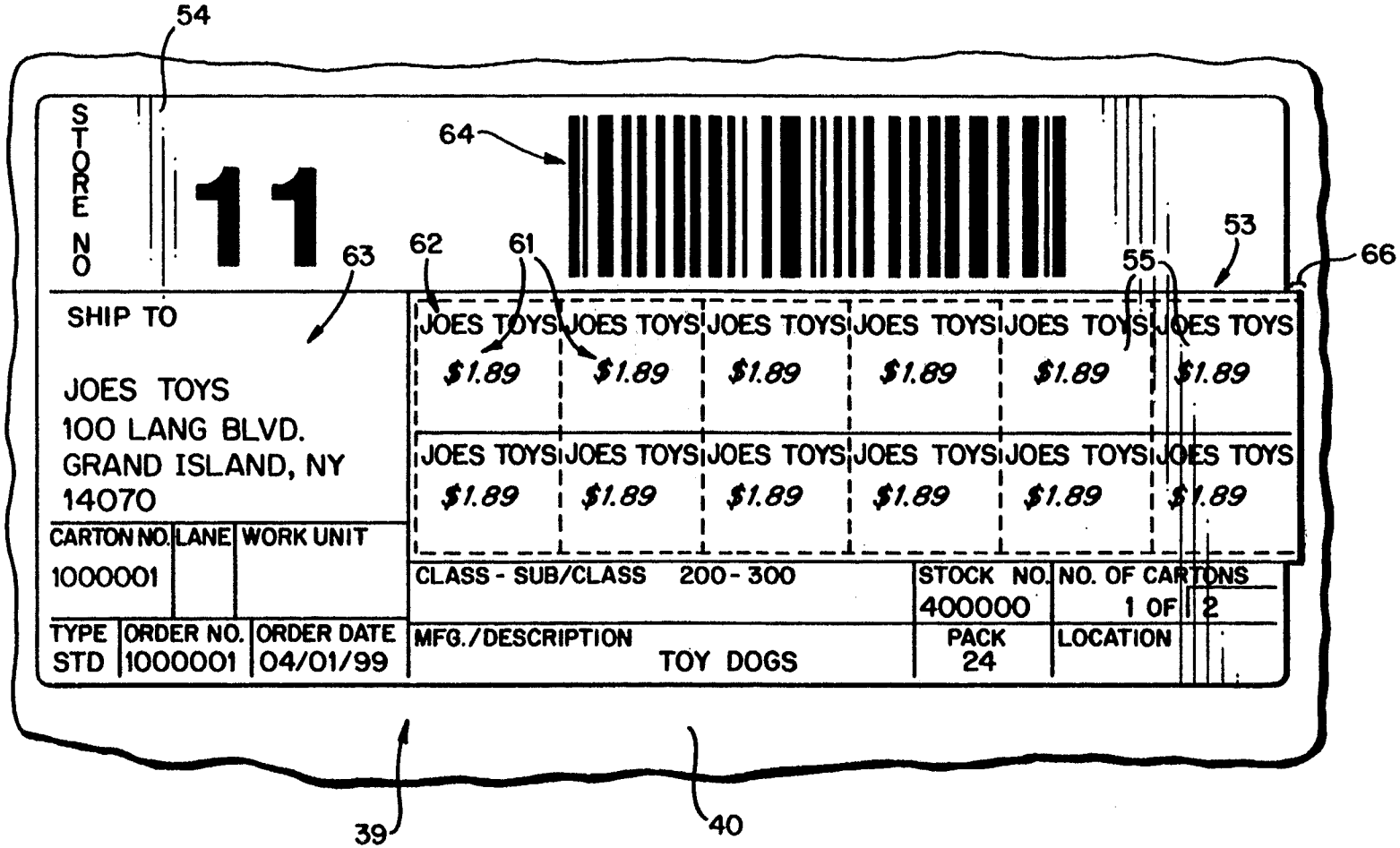
FIG. 4 is a detail top plan view of an exemplary label shown on a package, as in FIG. 3.

The label 39 has various indicia imaged thereon, typically when a cut sheet 10 is fed through a laser printer or the like. On each of the individual price tags 55 preferably price indicia is imaged, as indicated by reference numeral 61 in FIG. 4, as well as other indicia, for example the name of the store selling the articles within the box 41, such indicia indicated by reference numeral 62 in FIG. 4. A wide variety of indicia may be associated with the shipping portion 54 of the label 39, for example shipping address as indicated by alphanumeric indicia 63, a code generally corresponding to the address 63 (at least in part), as illustrated by indicia 64 in FIG. 4, as well as a wide variety of other types of indicia as seen in FIG. 4.

Note that the edge 51 of the second ply portion 18 of the label 39 (see FIGS. 2 and 4 in particular) is on the opposite side of the edge 47 of the first ply portion 17 of the label 39 from the edge 46 thereof, defining a tab portion 66. The tab 66 facilitates grasping by the user, and therefore separation of the price tag portion 53 from the rest of the label 39. Also, since the die cuts 34, 36, at portions thereof that converge with the perforation lines 57, 58, do not intersect the edge 11 of the second ply 18 (see FIG. 2), small tags of paper—seen at reference numeral 67 in FIG. 2—help hold the label 39 on the sheet 10 during processing through a printer.

Various structures according to the invention having been described, an exemplary manner of utilization thereof will now be set forth.

The cut sheet 10 is fed through a laser printer or the like and various indicia, such as the indicia 61–64, is imaged on the top face 23 of the first ply 17 thereof. Then the individual labels 39 are separated from the cut sheet 10, as illustrated in FIG. 2, by peeling the adhesive 25 associated with the shipping portion 54 of the label 39 from the underlying top surface 26 of the second ply 18, a portion of the second ply 18 underlying the price tags 55 separating with the top ply 17 in view of the die cut 33, the tags of paper 67 also separating during this removal process. Then the adhesive 25 surrounding the second ply 18 on about 270° of the perimeter thereof is applied to the exterior surface 40 of the cardboard box 41. This is done with a minimum of effort and labor, there being no necessity for folding under the price tags 55.

When the cardboard box 41 arrives at the final destination it is opened and the individual articles 42 therein removed. The price tag portion 53 of the label 39 is then separated from the label 39 on the exterior surface 40 of the box 41 by grasping the tab 66 and pulling to the left as seen in FIGS. 3 through 5, the price tags 55 detaching along the perforation lines 57 through 59. Then the individual price tags 55 are removed from the price tag portion 53—as seen most clearly in FIG. 5—with an individual price tag 55 being applied to each of the articles 42 by pressing the pressure sensitive adhesive 56 thereof into contact with an article 42.

It will thus be seen that according to the present invention a simple and advantageous shipping-price tag label, corresponding web of shipping-price tag labels, and package to which the label is applied, are provided. While the invention has been herein shown and described in what is presently conceived to be the most practical and preferred embodiment it will be apparent to those of ordinary skill in the art that massy modifications may be made thereof within the scope of the invention, which scope is to be accorded the broadest interpretation of the appended claims so as to encompass all equivalent products and devices.

What is claimed is:

1. A shipping-price tag label, comprising:

a first ply having a generally quadrate configuration, substantially parallel first and second edges, substantially parallel third and fourth edges, said third and fourth edges substantially perpendicular to said first and second edges, and first and second faces;

pressure sensitive adhesive substantially completely covering said second face of said first ply;

a substantially quadrate second ply having first and second substantially parallel edges, substantially parallel third and fourth edges, said third and fourth edges substantially perpendicular to said first and second edges, and first and second faces;

said first through fourth edges of said first ply being longer than said first through fourth edges, respectively, of said second ply;

said second ply first face having release material, and in engagement with said adhesive on said first ply second face, and readily releasable therefrom;

said second ply positioned with respect to said first ply so that said first and second edges of said second ply are between and substantially parallel to said first and second edges of said first ply, and so that said third edge of said second ply is between said third and fourth edges of said first ply; and said first ply having a price tag portion thereof overlying said second ply, said price tag portion comprising a plurality of individual price tags, each individually removable from said second ply and the rest of said first ply, and disposed in at least one row or column; and said first ply having a shipping label portion which does not overly said second ply.

2. A label as recited in claim 1 wherein said fourth edge of said second ply forms a tab allowing ready grasping and detachment of said price tags and at least a majority of said second ply from said shipping label portion of said first ply.

3. A label as recited in claim 2 further comprising first, second and third lines of weakness formed in said second ply parallel to and adjacent said first, second, and third edges, respectively, of said second ply and defining a first area, said price tags overlying said first area of said second ply; said first and second lines of weakness intersecting said fourth edge of said second ply, and said first through third lines of weakness cooperating with said tab to allow ready detachment of said price tags and said first area of said second ply from said shipping label portion of said first ply.

4. A label as recited in claim 3 further comprising price indicia imaged on said first face of each of said price tags of said first ply, and shipping indicia imaged on said shipping label portion of said first ply first face.

5. A label as recited in claim 1 further comprising price indicia imaged on said first face of each of said price tags of said first ply.

6. A label as recited in claim 5 further comprising shipping indicia imaged on said shipping label portion of said first ply first face.

7. A label as recited in claim 6 further comprising bar code indicia imaged on said shipping label portion of said first ply first face.

8. A web of shipping-price tag labels, comprising:

a first ply having first and second faces, said second face having pressure sensitive adhesive on at least a majority thereof;

a second ply having first and second faces, said first face having release material thereon, readily releasable from said pressure sensitive adhesive, and said first face in engagement with said adhesive of said second face of said first ply;

said first and second plies each having substantially parallel first and second side edges, said side edges also substantially parallel to each other;

a plurality of die cuts extending across said web substantially perpendicular to said side edges separating said first ply into a plurality of different shipping-price tag labels;

a generally C-shaped die cut formed in said second ply underneath each of said shipping-price tag labels, opening adjacent said first side edge of said second ply, having first, second and third edges, and defining an inner area;

a grid of die cuts formed in said first ply within a projection of said inner area of said C-shaped die cut of each of said shipping-price tag labels, defining at least one row or column of price tags; and first, second and third lines of weakness formed in said second ply within said inner area of each of said C-shaped die cuts, and substantially parallel and adjacent to said first through third edges of said C-shaped die cut.

9. A web as recited in claim 8 wherein said price tags comprise less than half of said first ply, and wherein substantially the entire second face of said first ply is covered with pressure sensitive adhesive, and wherein said grid comprises at least two columns and at least two rows.

10. A web as recited in claim 8 in the form of a cut sheet, each of said plies having end edges substantially parallel to each other and substantially perpendicular to said side edges.

11. A web as recited in claim 10 wherein said first ply edges are each shorter than the corresponding second ply edges.

12. A web as recited in claim 10 wherein three shipping-price tag labels are provided in each sheet.

13. A web as recited in claim 8 wherein said C-shaped die cut first and second edges are adjacent said first side edge of said second ply, so that said web correctly feeds in a printer, yet allowing ready removal of said price tags with associated second ply portion from said web.

14. A web as recited in claim 13 wherein said first edge of said first ply is between said first edge of said second ply and said second edge of said first ply, a tab portion defined by said second ply adjacent said price tags.

15. A web as recited in claim 14 further comprising price indicia imaged on said first face of each of said price tags of said first ply.

16. A web as recited in claim 15 wherein said first ply includes a shipping label portion exterior of said price tags in each of said shipping-price tag labels; and further comprising shipping indicia imaged on said shipping label portion of said first ply first face.

17. A web as recited in claim 16 further comprising bar code indicia imaged on said shipping label portion of said first ply first face.

18. A package containing a plurality of substantially identical articles, and comprising:

a cardboard box having an exterior surface;

a combination shipping-price tag label having a shipping portion and a price tag portion;

said shipping portion having a top surface with shipping indicia thereon, and a bottom surface substantially completely covered with pressure sensitive adhesive, said adhesive operatively engaging said cardboard box exterior surface;

said price tag portion having a perimeter, and comprising a plurality of individual price tags disposed in at least one row or column, and having a top surface with price-receiving indicia thereon for receipt of a price corresponding to a price of articles within said package, and a bottom surface with pressure sensitive adhesive thereon;

said price tag portion being bounded around the majority of the perimeter thereof by said shipping portion, and said price tag portion top surface substantially flush with said shipping label portion top surface; and a release sheet disposed between said price tag portion bottom surface and said cardboard box exterior surface.

19. A package as recited in claim 18 further comprising tab means for facilitating ready grasping of said price tag portion and perforation means for facilitating ready separation thereof from said surrounding shipping portion so that said plurality of price tags, backed by a release sheet, may be readily detached from said package.

* * * * *